US006609739B1

(12) United States Patent
Avganim

(10) Patent No.: US 6,609,739 B1
(45) Date of Patent: Aug. 26, 2003

(54) LOCKING DEVICES FOR GATES AND THE LIKE

(76) Inventor: Meir Avganim, Moshav Gealiya 76885, Israel, Moshav Gealiya (IL), 76885

( * ) Notice: Subject to any disclaimer, the term of this patent is extended or adjusted under 35 U.S.C. 154(b) by 0 days.

(21) Appl. No.: 09/959,091

(22) PCT Filed: Aug. 4, 1998

(86) PCT No.: PCT/IL98/00364

§ 371 (c)(1),
(2), (4) Date: Sep. 24, 2001

(87) PCT Pub. No.: WO00/08282

PCT Pub. Date: Feb. 17, 2000

(51) Int. Cl.[7] ..... E05C 19/18

(52) U.S. Cl. ..... 292/295; 292/342; 292/288; 70/2; 70/14; 70/38 A; 70/56

(58) Field of Search ..... 70/14, 54–56, 70/38 A, 2, 6, 39, 58; 292/342, 343, 295, 340, 281–288

(56) References Cited

U.S. PATENT DOCUMENTS

| | | | | | |
|---|---|---|---|---|---|
| 911,192 | A | | 2/1909 | Zielenski | 70/101 |
| 957,033 | A | * | 5/1910 | De Bruycker | 70/38 A |
| 3,451,235 | A | * | 6/1969 | Weingart | 70/14 |
| 3,820,360 | A | * | 6/1974 | Best | 70/6 |
| 3,996,774 | A | * | 12/1976 | Best | 70/32 |
| 4,003,227 | A | * | 1/1977 | Casey | 70/14 |
| 4,072,333 | A | * | 2/1978 | Hutter, III | 292/292 |
| 4,103,949 | A | * | 8/1978 | Bouloy | 292/342 |
| 4,190,273 | A | * | 2/1980 | Schaffrin | 292/288 |
| 4,347,720 | A | * | 9/1982 | Kenyon | 70/14 |
| 4,399,672 | A | | 8/1983 | Moorhouse | 70/14 X |
| 4,881,387 | A | * | 11/1989 | Kortenbrede | 70/39 |
| 4,938,041 | A | * | 7/1990 | O'Gara | 70/33 X |
| 5,127,244 | A | * | 7/1992 | Myers | 70/2 |
| 5,377,511 | A | * | 1/1995 | Meckbach | 70/38 A |
| 5,398,529 | A | * | 3/1995 | Goldman et al. | 70/38 A |
| 5,417,092 | A | * | 5/1995 | Iu | 70/38 A |
| 5,839,302 | A | * | 11/1998 | Chu | 70/38 A |
| 5,896,761 | A | * | 4/1999 | Chen | 70/38 A |
| 5,941,102 | A | * | 8/1999 | Reinholdsson et al. | 70/2 |
| 5,946,952 | A | * | 9/1999 | Mintchenko | 70/2 |
| 6,233,984 | B1 | * | 5/2001 | Blehi, III | 70/34 |
| 6,357,266 | B1 | * | 3/2002 | Van Buren | 70/56 |

* cited by examiner

*Primary Examiner*—Suzanne Dino Barrett
(74) *Attorney, Agent, or Firm*—Ostrolenk, Faber, Gerb & Soffen, LLP

(57) ABSTRACT

A locking device (20) for double-wing gates (10, 12). The lock comprises a pair of base plates (16, 18), each secured to one of the wings so that in the closed position thereof the members (**18*d*, 16*d*) are located side by side. At least one of the projecting members is formed with a dead-body receiving cavity (16*g*, 18*g*). A lock body (20) is provided, having a side portion formed with respective recesses (20*a*, 20*b*) configured and located so as to fit over both the projecting members. The lock body (20) is equipped with a key-operated locking mechanism (22) comprising at least one dead-bolt receiving cavity of the respective anchor member thereby preventing the disengagement of the lock body (20) from both anchor members. The projections (16*d*, 18*d***) may be in the form of elongated ribs, or cylindrical pins.

9 Claims, 12 Drawing Sheets

LOCKING DEVICES FOR GATES AND THE LIKE

BACKGROUND OF THE INVENTION

The present invention relates to locking devices, and particularly to locks for swingable or slidable doors and windows.

The invention is particularly useful for locking hinged wings of gates and therefore will be described in conjunctions with such application although, as will be explained, is by no means limited thereto.

Conventional gate locks are in the form of a pair of protective matching shells which are welded to opposite edges of the door wings the two abut one against the other forming a protective hasp into which the two legs of an ordinary padlock shackle can be inserted (from above). The padlock body is brought from below and locked to the shackle.

These devices suffers a main disadvantage due to the fact that matching or assembly is required of at least two separate parts, namely the shackle on the one hand, and the lock body on the other hand; and then, the parts must be separately stored for the following use.

From another, human engineering aspect, this locking method is cumbersome, inconvenient and time consuming apart from the chance that the padlock body may drop on the foot of the user and cause him injury.

Furthermore, the welding method of the two protective shells is unsafe, and liable to be tampered with or forced away by sawing or flame-cutting tools.

Thus it is a general object of the invention to provide a lock of the kind referred to above which is more simple in installation and in use, with lesser number of separable parts.

SUMMARY OF THE INVENTION

Thus provided according to the invention is a locking device, particularly for locking to each other wings of gates, sliding doors and the like. First and second anchor members, each with a projecting member, are respectively mounted to the wings so that in the closed position thereof the members are located side by side. At least one of the projecting members is formed with a dead-bolt receiving cavity. A lock body is provided, having a side portion formed with respective recesses configured and located so as to fit over both the projecting members. The lock body is equipped with a key-operated locking mechanism comprising at least one dead-bolt adapted to become inserted into the dead-bolt receiving cavity of the respective anchor member thereby preventing the disengagement of the lock body from both anchor members.

It is preferable, according to a first embodiment that the projections are in the form of ribs of a varying width seen in a direction perpendicular to the plane of their respective wing.

According to a second embodiment, the projections are in the form of elongated cylindrical bolt pins extending perpendicularly to the planes of their respective wings.

DETAILED DESCRIPTION OF PREFERRED EMBODIMENTS

These and additional features of construction and advantages of the invention will become more clearly understood in the light of the ensuing description of several preferred embodiments thereof, given by way of example only, with reference to the accompanying drawings, wherein.

Figure 4:
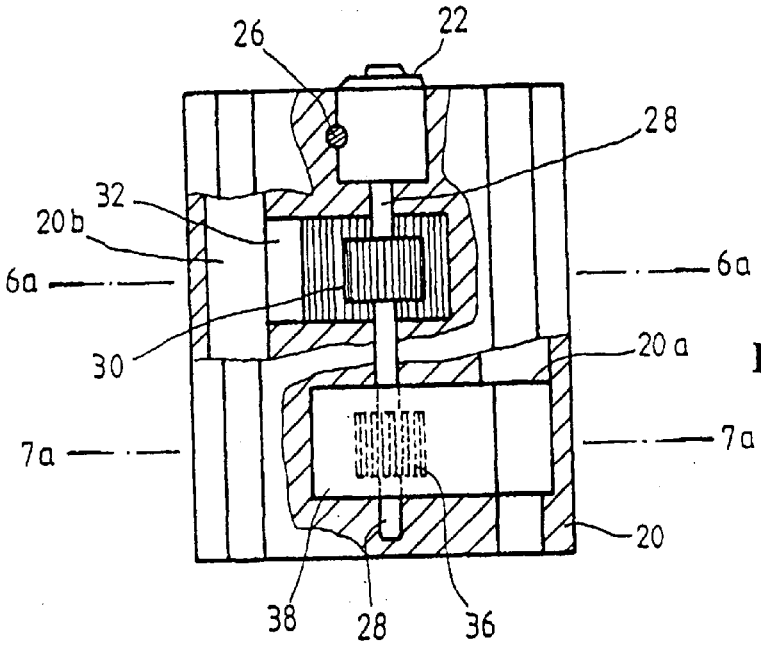
FIG. 4 is a fragmental elevation of the lock body of FIG. 1.
Figure 5:
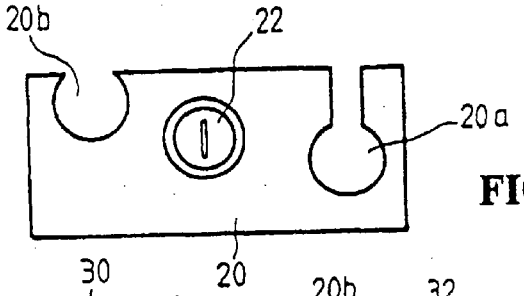
FIG. 5 is a top view of the lock body of FIG.4.
Figure 6B:
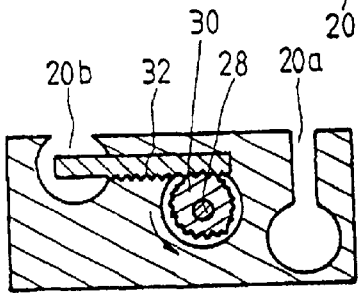
Figure 6A:
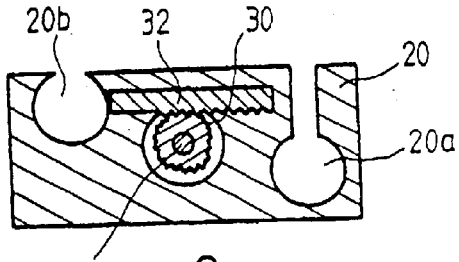
Figure 7B:
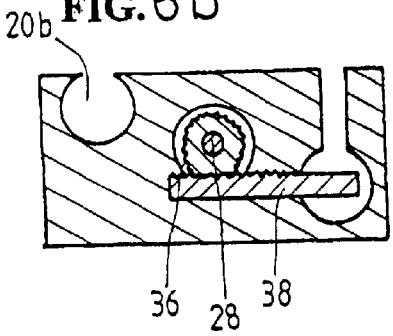
Figure 7A:
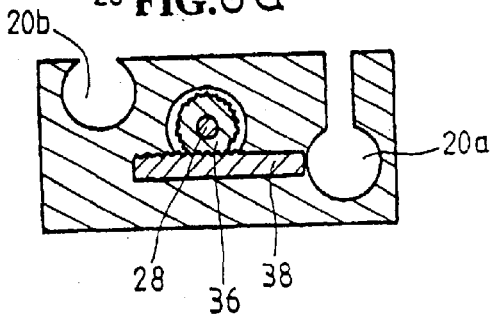

FIG. 6*a* is a section taken along line 6*a*—6*a* of FIG.4;

FIG. 6*b* shows the device of FIG. 6*a* in the locking position of its dead-bolt;

FIG. 7*a* is a section along line 7*a*—7*a* of FIG. 4;

FIG. 7*b* illustrates the locking position of the device of FIG. 7*a;*

Figure 1:
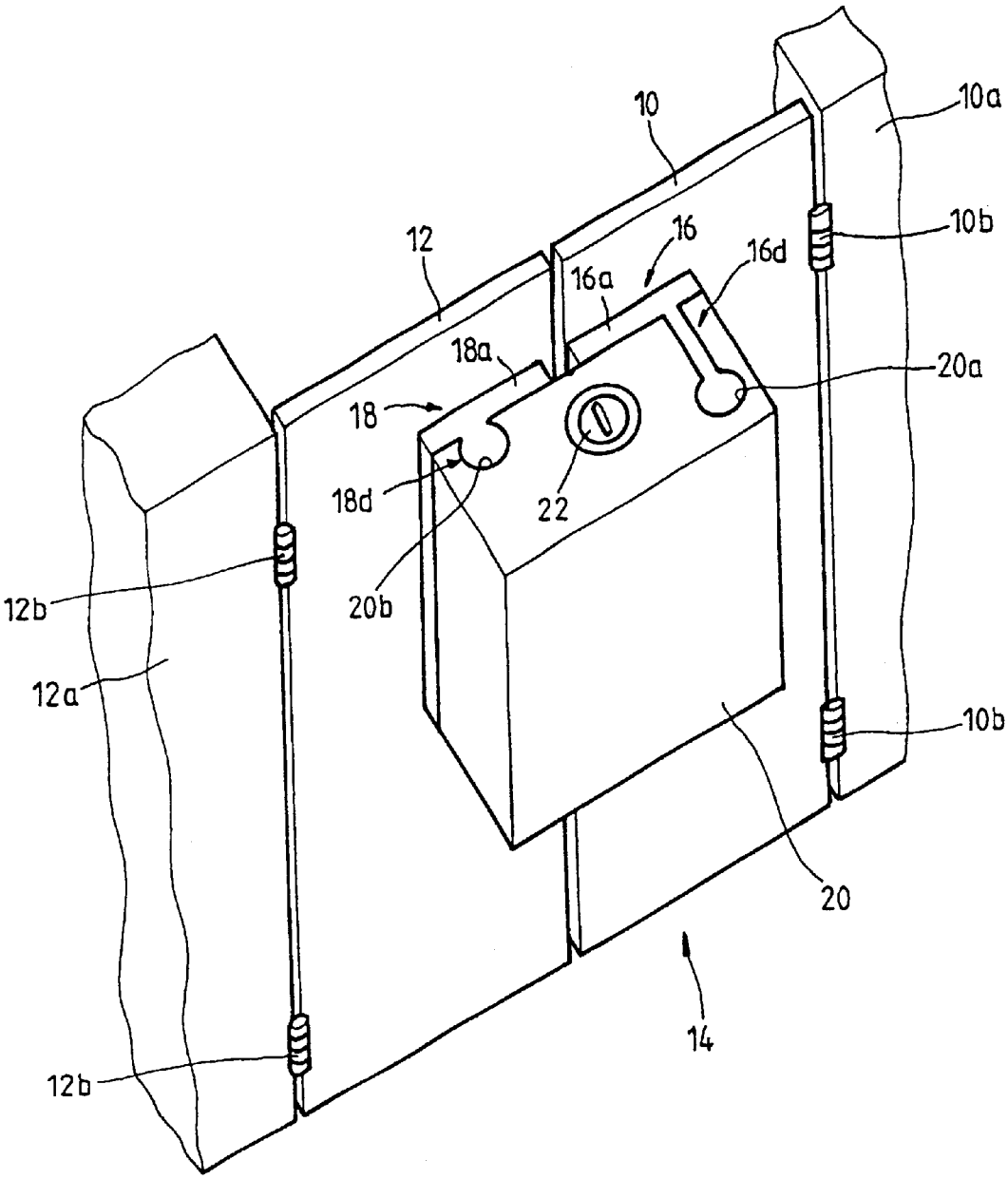
FIG. 1 is general, schematic, perspective view of a locking device according to a first preferred embodiment of the invention, in its locked position.
Figure 8A:
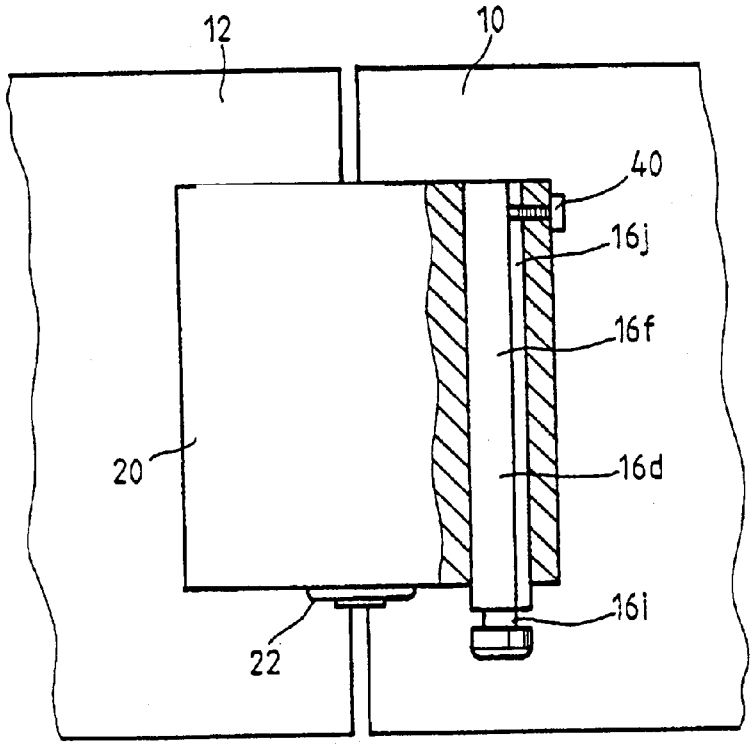
Figure 8B:
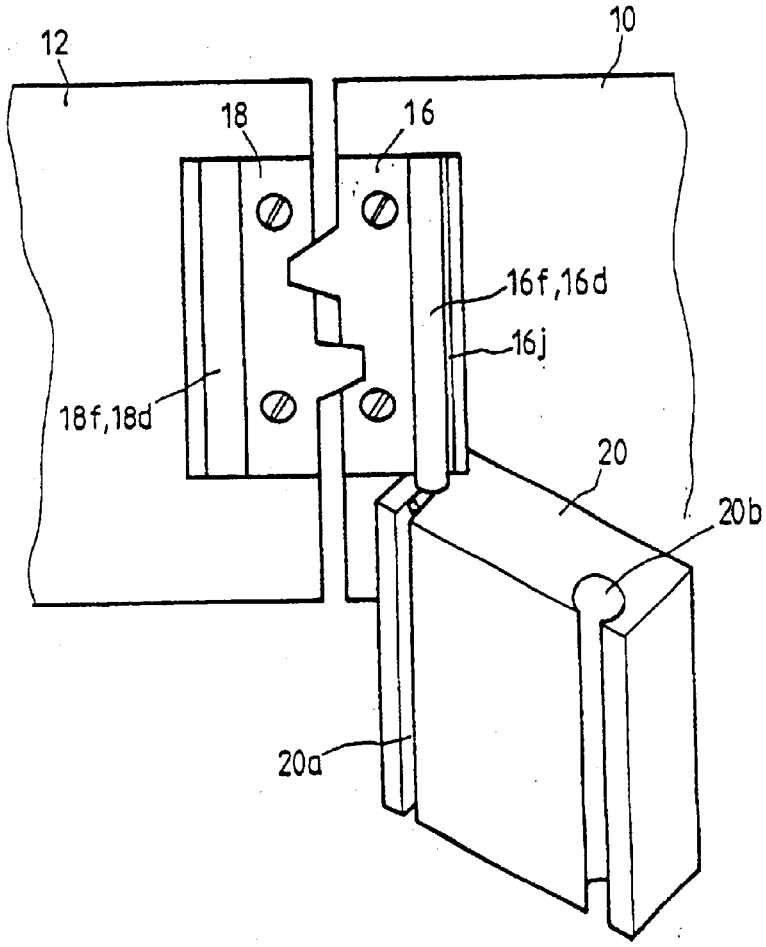
Figure 13:
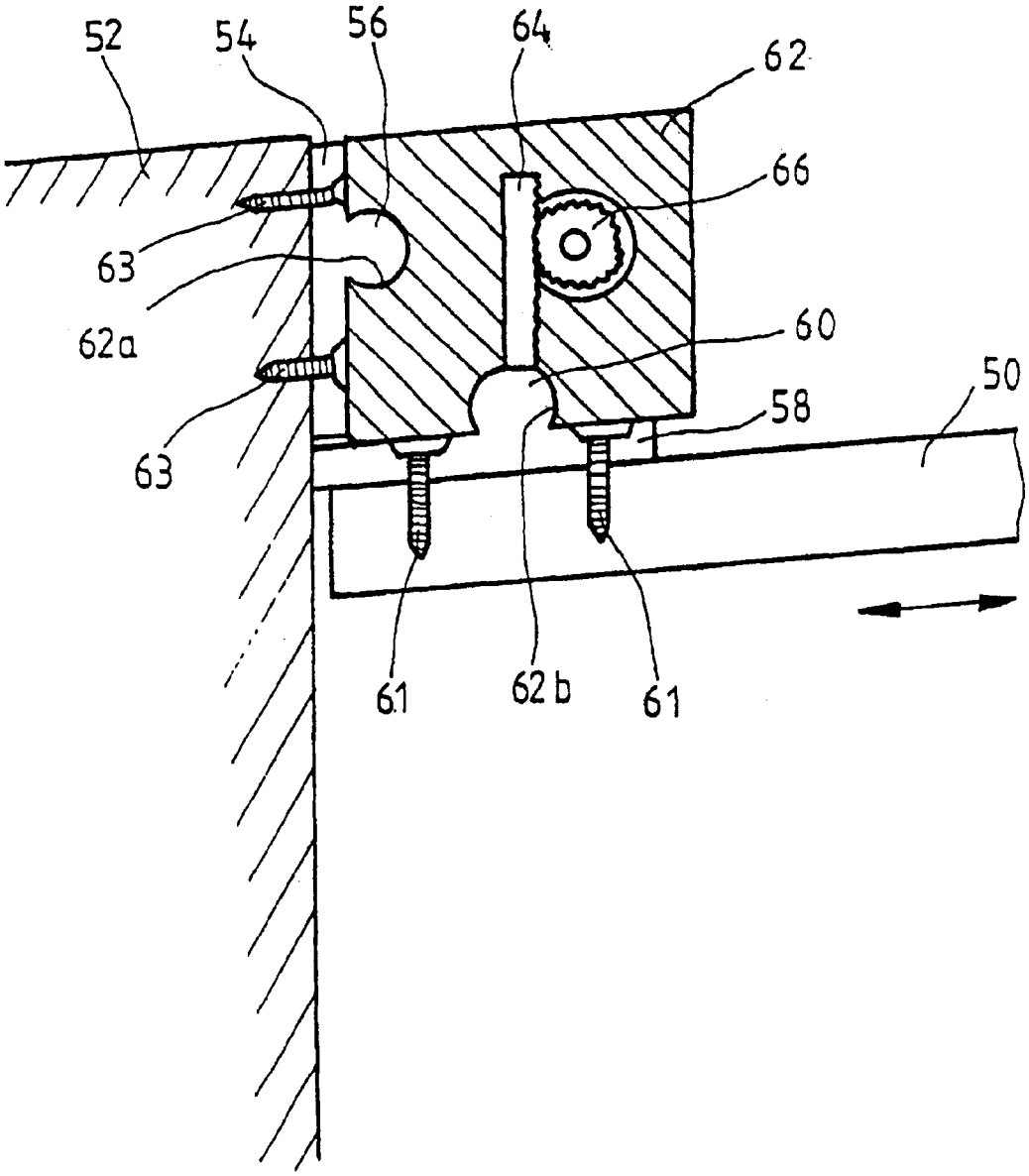

FIG. 8*a* illustrates a further improvement of the locking device of FIG. 1;

FIG. 8*b* shows the lock of FIG. 8*a* in its unlocked position;

FIGS. 9–12 illustrate several modified embodiments of the locking device according to the teachings of the present invention;

FIG. 13 is a still further modified embodiment of the invention suitable for locking of a sliding door or window against a wall or the like stationary object.

Figure 14A:
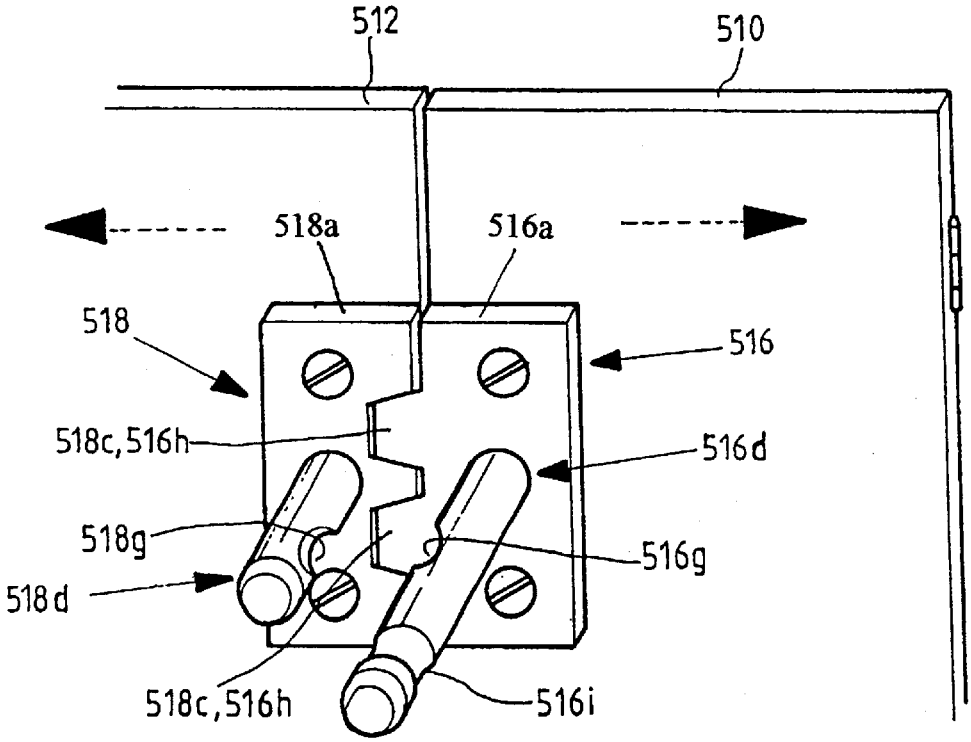
Figure 14B:
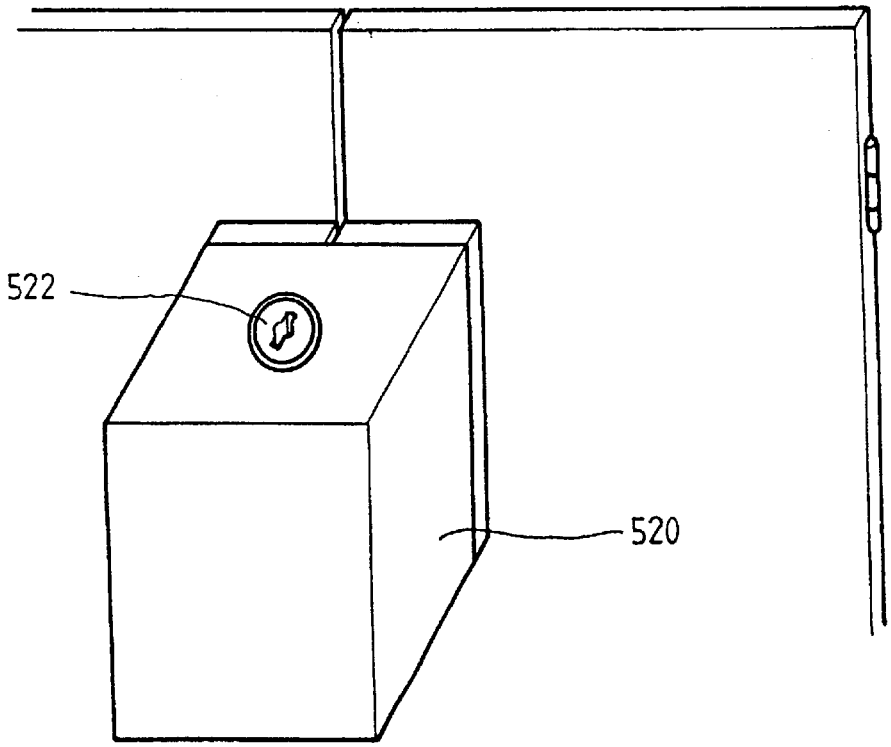

FIG. 14*a* is a still further modified embodiment a locking device, employing pin-shaped bolts instead of elongated ribs;

FIG. 14*b* shows the lock body engaging the bolts of FIG. 14*a;*

Figure 15:
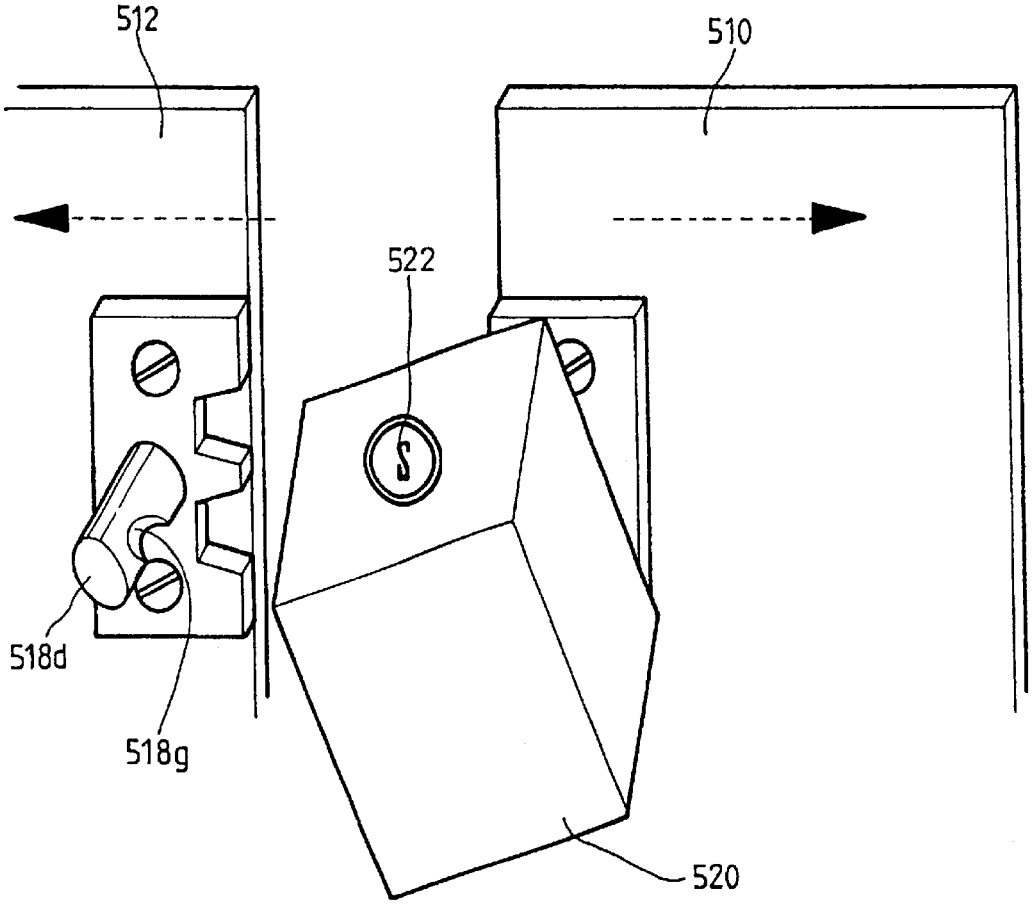
Figure 16:
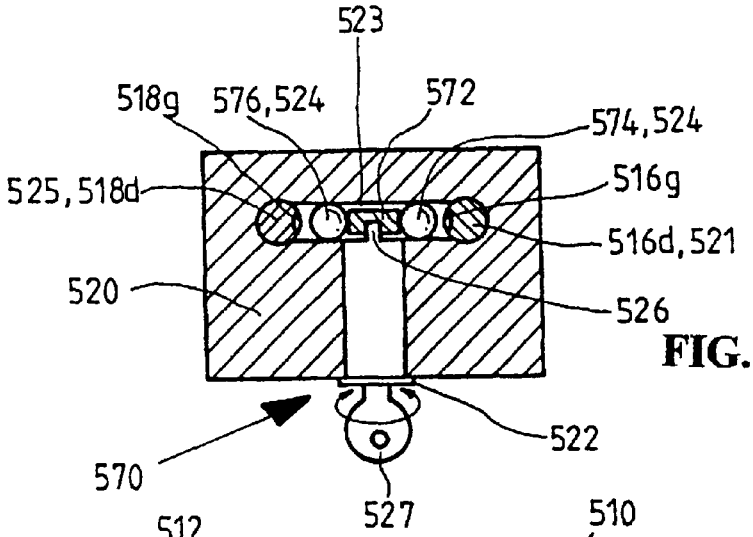

FIG. 15 shows the locking device of FIG. 14*b* in the unlocked state;

FIG. 16 is a sectional view of the lock body of FIG. 14*b;*

Figure 17:
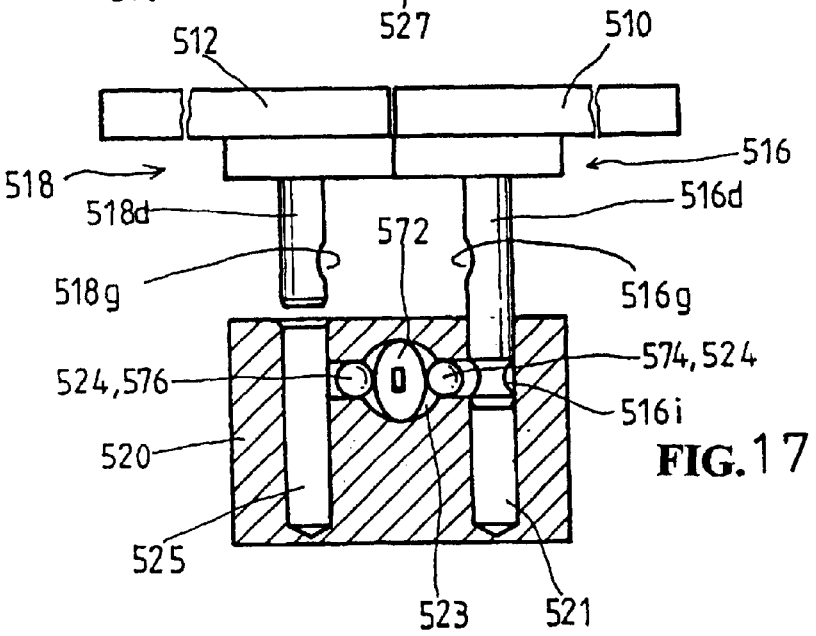
Figure 18:
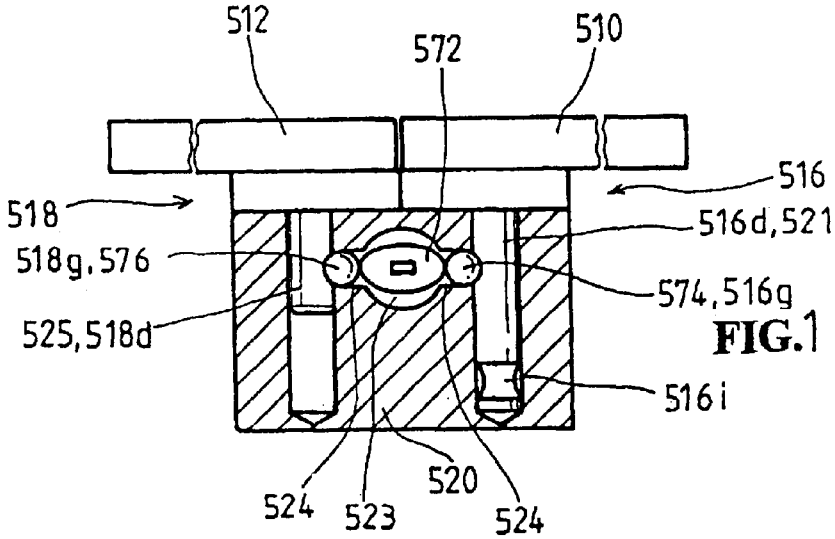
Figure 19B:
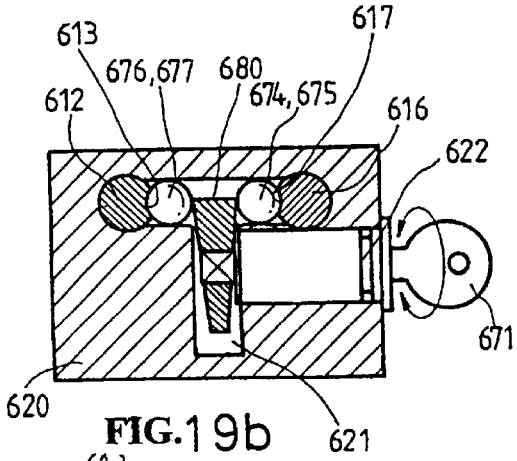
Figure 19A:
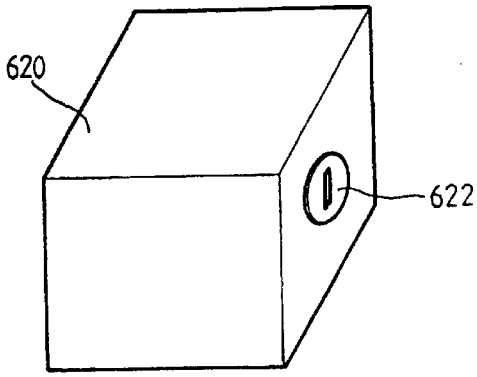
Figure 19C:
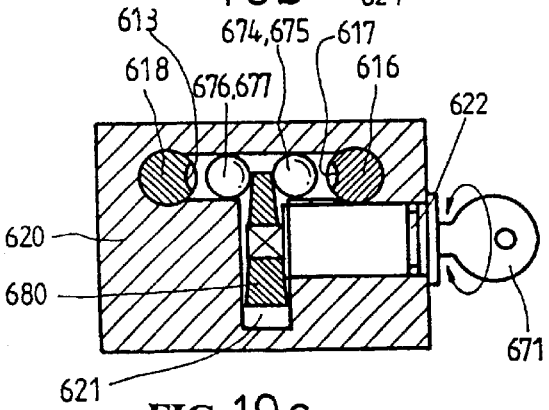
Figure 20:
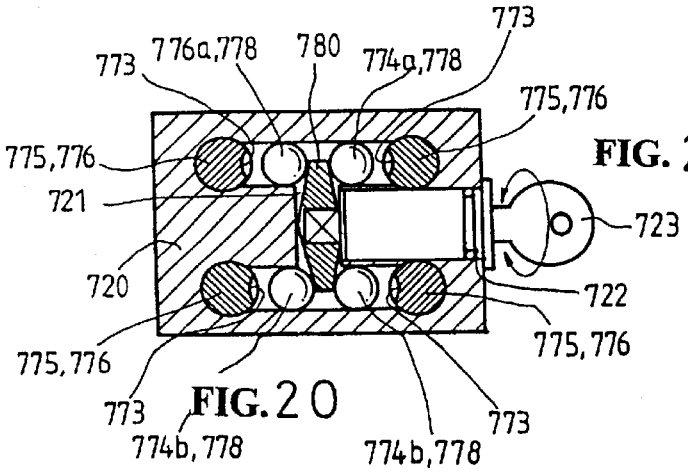
Figure 21B:
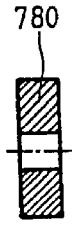
Figure 21A:
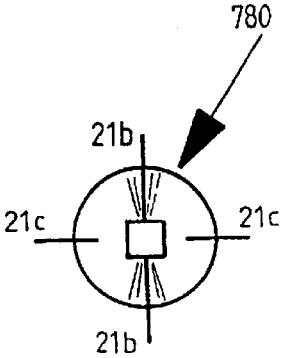

FIG. 17 is a sectional view showing the locking device in an unlocked position;

FIG. 18 shows the device of FIG. 17 in the locked position;

FIGS. 19*a*–19*c* illustrate the use of a modified locking mechanism;

FIG. 20 is another modification of the locking mechanism, co-operating with two pairs of locking bolts;

FIG. 21*a* is a top view of an operator disc used in the mechanism of FIG. 20;

FIG. 21*b* is a section along line 21*b*—21*b* of FIG. 21*a;*

Figure 21C:
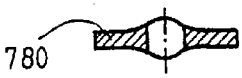

FIG. 21*c* is a section along line 21*c*—21*c* of FIG. 21*a;*

Figure 22B:
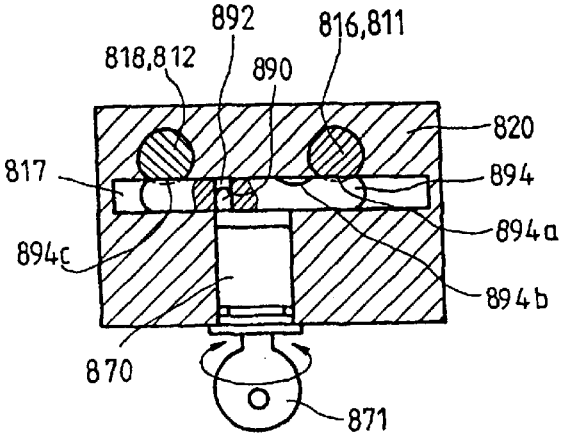
Figure 22A:
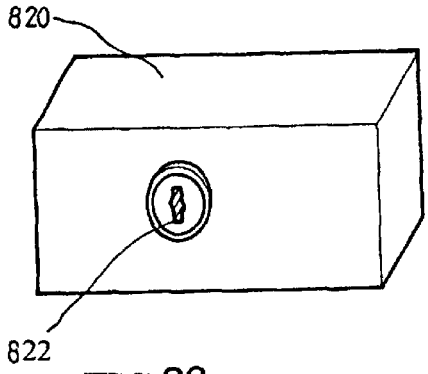
Figure 22C:
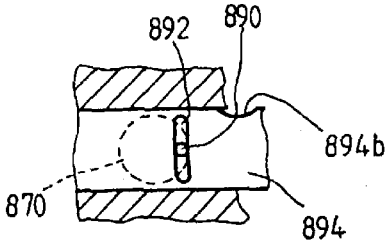
Figure 22D:
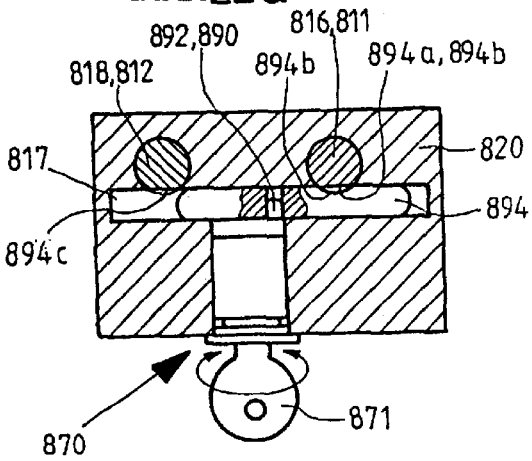
Figure 23:
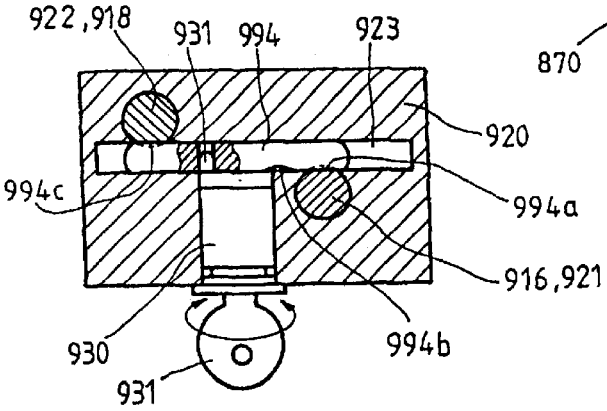

FIGS. 22*a*–22*d* illustrate a modified embodiment of the locking mechanism useful in the device of FIG. 16; and FIG. 23 is a modified version of the lock of FIG. 22.

DETAILED DESCRIPTION OF THE PREFERRED EMBODIMENTS

Figure 2:
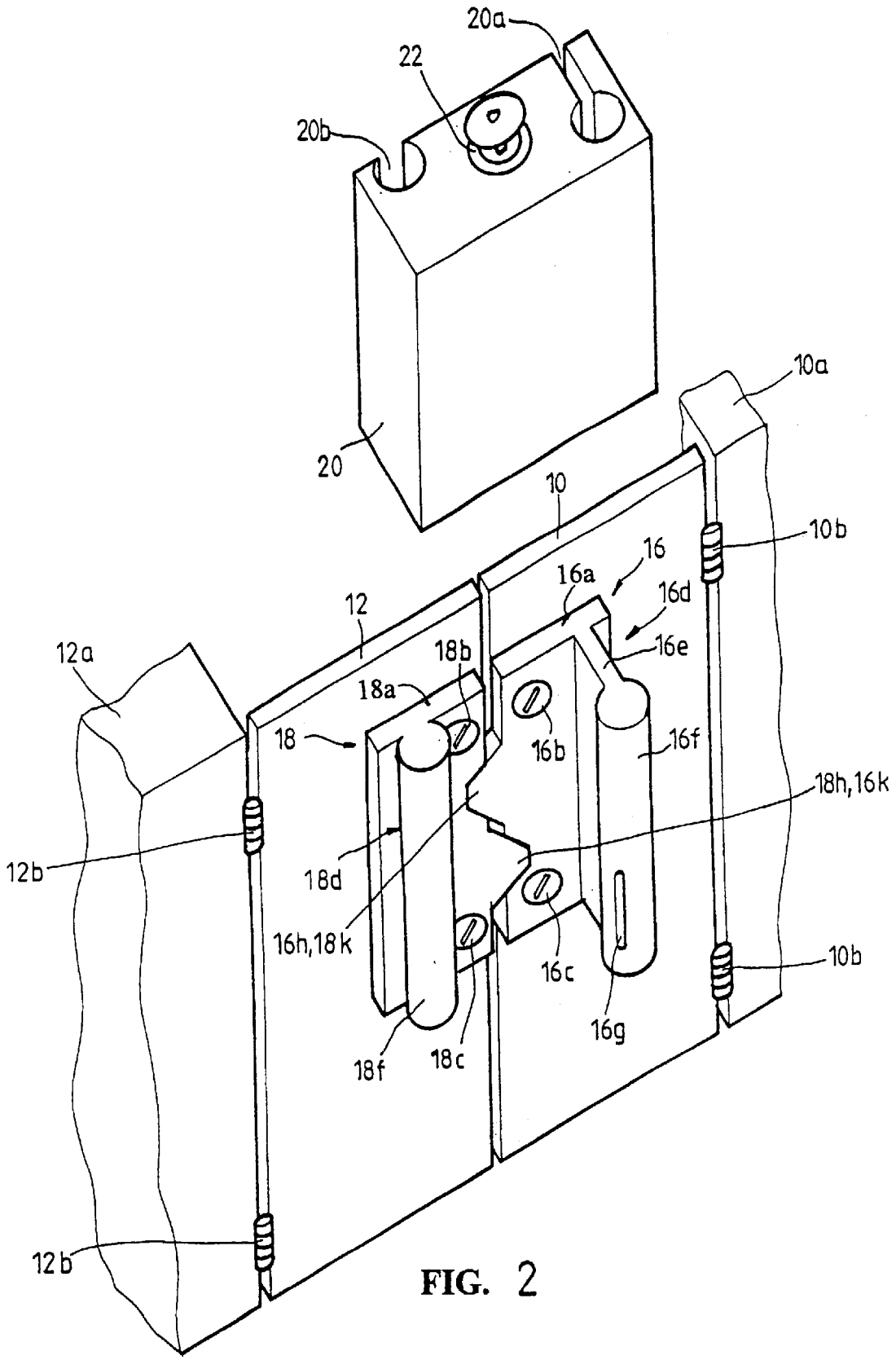
FIG. 2 illustrates the first stage of unlocking of the device of FIG. 1.
Figure 3:
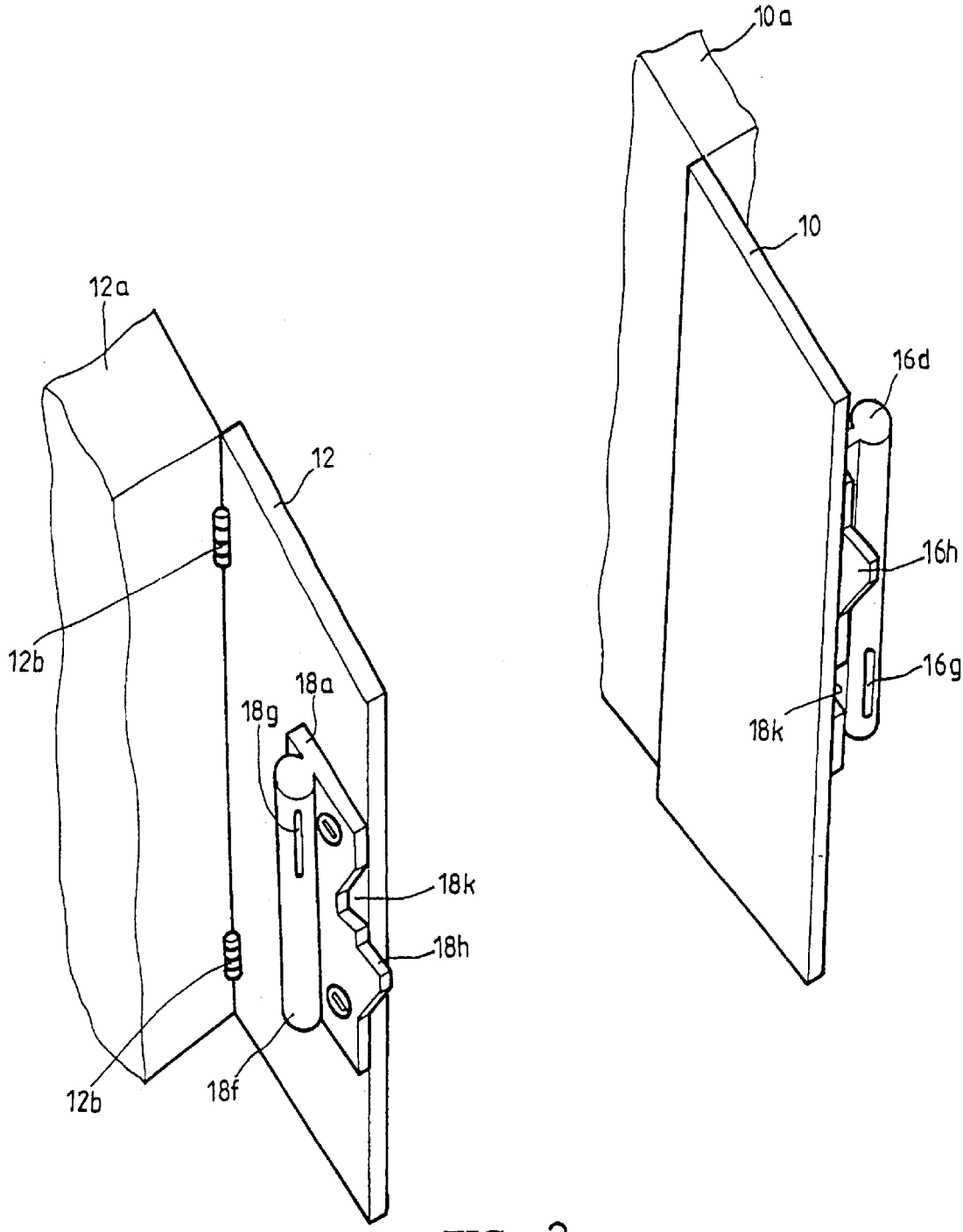
FIG. 3 illustrates the opening of the door wings after unlocking.

Referring now to FIGS. 1–3 there are shown a pair of gate wings 10 and 12 hinged to respective gate jambs 10*a* and 12*a*. The wings 10 and 12 are locked one against the other by locking device generally denoted 14.

The locking device 14 essentially comprises three elements: a first anchor member generally designated 16; a second anchor member 18; and the lock body 20.

The anchor member 16 (see FIG. 2) comprises a base plate 16*a* fastened to door wing 10, e.g. by a pair of bolts 16*b* and 16*c*. The member 16 further comprises a projecting rib, generally denoted 16*d* which, as will be explained below, may be of various shapes and configurations.

In the present example the rib 16*d* has a stem rib portion 16*e* and a circular head portion 16*f* with a dead-bolt receiving cavity 16*g*.

Likewise, anchor member 18, attached to door wing 12, comprises the corresponding elements denoted 18*a*–18*g*. However, the head portion 18*f* is closer to the plate portion 18*a*, so that the counter part of the rib stem (corresponding to 16*e*) is non-existent in this example.

The plates 16*a* and 18*a* may be provided with intermatching projections 16*h* and 18*h* fitting one into a complementary notch formed in the other (16*k*; 18*k*), to achieve lateral alignment and stabilization of the two members (and of the door wings proper).

The lock body 20 is generally block shaped, the parts and components incorporated therein will be described later. At this stage it will suffice to note (see FIG. 2) that the sidewall of block 20 is formed with a pair of profiled slots 20*a* and 20*b* of shapes and dimensions complementary (with some freedom) to the ribs 16*d* and 18*d* associated with the members 16 and 18.

Locking mechanism generally denoted 22 is provided for effecting the locking of the block to one or both of the ribs 16*d*, 18*d* (see below). When unlocked, the lock body 14 can be simply removed by sliding upwards or downwards until separated and released from the grip of the respective ribs. The gate is than openable as illustrated in FIG. 3.

The locking of the gate is performed of course in the opposite order of operations.

Proceeding now to the particulars of the locking mechanism within the block 20, it should be emphasized that this is but one of many possible designs. Hence, as shown in FIG. 4, there is provided a key-operated locking mechanism, denoted 24, e.g. of the cylinder-lock type, held within the block 20 by fixing means such as set-screw or pin 26. This will enable easy replacement of the cylinder, if required, and also facilitate the supply of "key-alike" series of devices at no extra effort.

The rotor of the cylinder locking device (not shown) is extended by spindle 28 down to the other side of the block. A first gear pinion 30 is mounted, being engaged with a first, toothed rack operated dead-bolt 32. The dead-bolt 32 is so located that upon rotation of the pinion 30 it will become displaced into the slot 20*b*, (and thus into the dead-bolt slot 18*g*); likewise, a second gear 36 and a second rack 38 may be included for locking the rib 16*d* accommodated in the slot 20*a*, as shown in FIGS. 7*a* and 7*b*.

It should however be noted that a single dead-bolt displacing arrangement will suffice for the operation of the locking device.

It will be further noted that access to the mounting bolts 16*b*, 16*c* and 18*b*, 18*c* is effectively prevented in the locked position of the device unlike the conventional devices where the welding around the protective shells is always exposed and liable to forceful burglary.

The modification of FIGS. 8*a* and 8*b* resides in that in order to avoid the complete separation of the lock body 20, the rib head portion 16*f* is extended downwards beyond the bottom surface of the housing 20. The extended portion comprises a shoulder 16I. Further, a slot 16*j* is made all along the rib head portion 16*f*, cooperating with a set screw 40. In this arrangement, the lock body 20, when released from engagement with both ribs 16*d* and 18*d*, may slide down and rotate sidewise while being held by the shoulder 16*I* (against the screw 40) so that the opening of the door wings (as described in FIG. 3) is not interfered, and the lock body is kept safe and not liable to become lost.

From the foregoing description it will be evident that each of the locking ribs and complementary slots may lend itself to a great variety of configurations and geometrical shapes. Hence, in the example of FIG. 9, simple rectangular or somewhat conical ribs 116 and 118 are used. In that case, two dead-bolts 132, 138 are required, each engaging its respective rib, as clearly shown.

Figure 10:
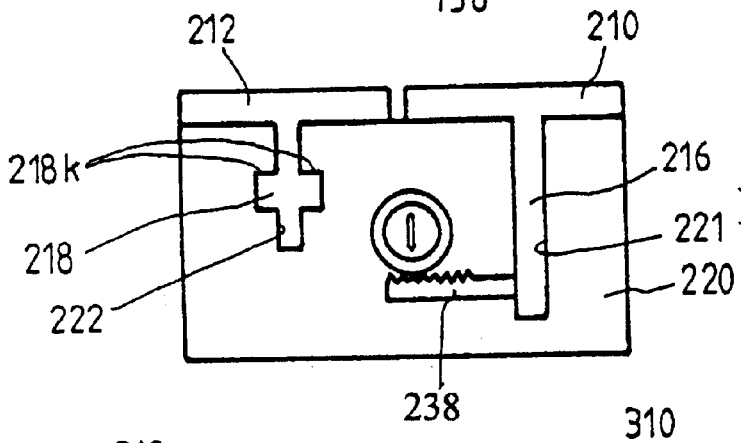

In FIG. 10 rib 216 is planner, while rib 218 has an undercut surface 218*k*, which dictates a sliding movement mounting of the housing 220. One locking bolt 238 is provided, associated with rib 216.

Figure 11:
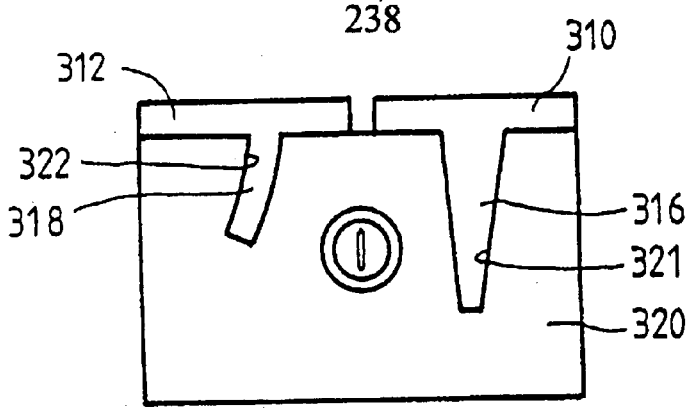

The same applies to the configuration of FIG. 11 where rib 318 is arcuate and rib 316 is conical or wedgelike.

Figure 12:
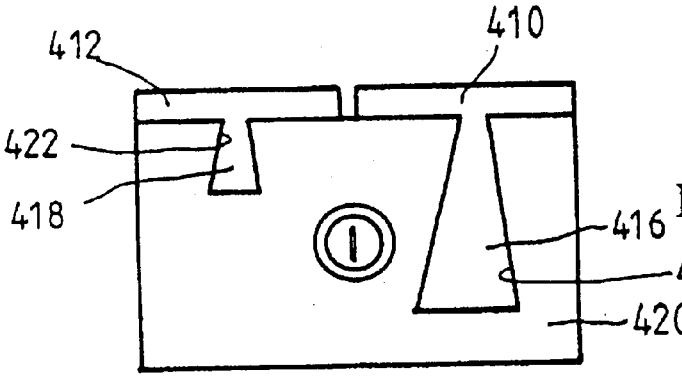

In FIG. 12 both ribs 416 and 418 are wedge-shaped, having their narrow side merging from the respective plates 410 and 412 (a dove-tail engagement).

Yet another embodiment of the invention is shown in FIG. 13 applicable for locking a sliding door denoted 50 against wall 52 or any other stationary object. In more detail, and following the same design principles, mounting plate 54 with circular rib 56 is mounted to the wall 52, and plate 58 with similar rib 60 is mounted to the outer face edge of the sliding door 50. The lock body 62 has slots 62*a* and 62*b* conforming (with some freedom) to projections 56 and 60 with at least one displaceable dead-bolt 64 movable by pinion 66 of cylinder or other locking mechanism. The locking and unlocking of the lock body 62 is performed in a similar manner as described above.

Figure 9:
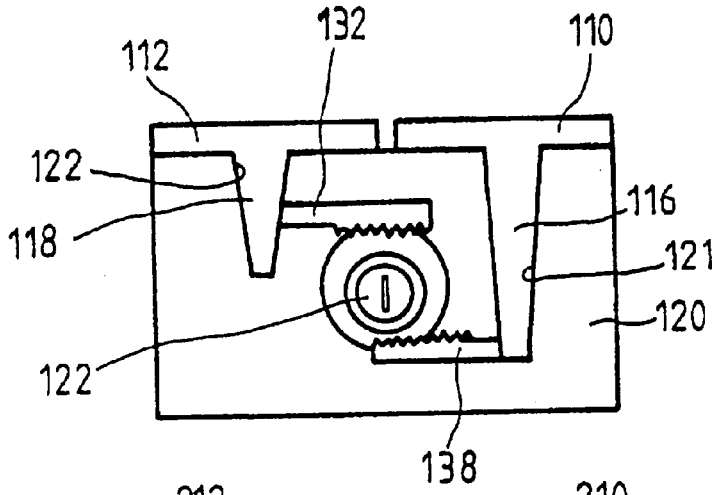

FIGS. 14–23 generally pertain to a diversified form of the present invention, wherein the common denominator resides in that the protruding members are pin-like bolts—rather than elongated ribs—which are interlocked not by sliding of the lock body, but in a head-on fashion (as already mentioned in connection with the embodiment of FIG. 9 above).

As already seen in FIG. 14*a*, gate wings 510, 512 (sliding or hinged—as the case may be) are again provided with anchor members 516, 518 in the form of base plates 516*a*, 518*a* with projecting pins 516*d*, 518*d* and dead-bolt cavities 516*g* and 518*g*.

A cylindrical recess 516I is also proposed—similar in function to that described and shown in FIG. 8*a*.

The pins are preferably somewhat loosely held on their base plates, to facilitate smooth insertion into the matching bores of the lock body 520 (see below).

The locking and unlocking of the device—including the option to leave the lock body 520 arrested to one of the bolts (516*d*)—is self-explanatory with regard to FIGS. 14*b* and 15 in general and FIGS. 16–18 in particular. Thus, there is proposed in the last mentioned example a simple rotary cylinder-type locking mechanism 570 installed in the lock body 520. An elliptic operator member 572 is coupled to the rotor, designed to push away from each other a pair of steel balls 574, 576 into the recesses 516*d*, 518*d*, respectively (FIG. 18).

It is sometimes advisable to have the key-hole (622 in FIG. 19*a*) be located at aside wall of the lock body—rendering same more burglary-safe (by boring through the cylinder-pin assembly).

Hence, the lock body 620 of FIGS. 19*a*–19*c* satisfy this condition, by employing a tapered disc 680.

The locking and unlocking states are thus represented in FIGS. 19*b* and 19*c*, respectively.

Yet, another possibility, of using four lock bolts rather than only two, is exemplified in FIGS. 20, 21 with respect to lock body 720.

The disc 780 is of composite profile, as clearly seen in FIGS. 21*a*–21*c*, namely having alternately varying widths regarding its main axises (sections 21*b*—21*b* and 21*c*—21*c*).

The lock body 820 of FIGS. 22*a*–22*d* has the key-hole 822 installed at its front wall. To enable that—rotor 870 is coupled via an eccenter pin 890 and slot 892 to a reciprocable plate 894 having at least one bolt releasing disperation 894*b*; the bolt 816 is formed with a transverse slot 894*a* and the bolt 818—with slot 894*c*. The locked and unlocked states are illustrated in FIGS. 22*b* and 22*d*, respectively.

The embodiment of FIG. 23 is modified only in that the locking bolts 916 and 918 are positioned at different, opposite sides of the reciprocable plate 994, i.e., in separate, distanced planes.

It has thus been established that the locking device featuring the characteristics of the presenting better security properties than the conventional devices for parallel uses.

Those skilled in the art will readily appreciate that numerous changes, variations and modifications may be applied to the invention as hereinbefore exemplified without departing from the scope of the invention as defined in and by appended claims.

What is claimed is:

1. A locking device, particularly for locking to each other wings of gates, sliding doors and the like, comprising:

first and second anchor members, each provided with a projecting member, respectively mounted to the wings so that in the closed position thereof the members are located side by side;

at least one of the projecting members being formed with a dead bolt receiving cavity;

a lock body having a side portion formed with respective recesses configurated and located so as to fit over both projecting members;

a key-operated locking mechanism comprising at least one dead-bolt adapted to become inserted into the cavity for securing the lock body to the respective anchor member; and arresting means for avoiding the separation of the lock body from one of the anchor members in the unlocked position of the device.

2. The locking device as claimed in the claim 1 wherein the arresting means comprise an extension of one of the ribs, a slot being formed along the rib, a pin projecting into the slot, enabling the sliding movement of the lock-body to said unlocked position, whereby the lock-body remains coupled to the extended portion of the said one rib.

3. A locking arrangement, said locking arrangement comprising:

first and second anchor members, each of said anchor members comprising an elongated, rib-shaped projecting member, at least one of said projecting members formed with a dead-bolt receiving cavity, and each of said anchor members adapted to be mounted to a entryway structure, such that when the entryway structure is in a closed position, said projecting members are positioned alongside and parallel with each other and a width of at least one of said projecting members increases in a direction away from the entryway structure;

a lock body comprising a side portion formed with first and second recesses, each one of said recesses is correspondingly shaped to receive a respective one of said projecting members by sliding said recesses over said projecting members in a direction parallel to the entryway structure and when the latter is in a closed position; and a key-operated locking mechanism located in said lock body and comprising at least one dead-bolt member, wherein said dead-bolt member is adapted to be inserted into said dead-bolt receiving cavity and to secure said lock body to said anchor members when said recesses have received said projecting members.

4. The locking arrangement of claim 3, wherein said first projecting member is wider than said second projecting member.

5. The locking arrangement of claim 3, wherein at least one of said projecting members and said at least one respective recess is dove-tailed.

6. The locking arrangement of claim 3, wherein dead-bolt member is coupled to a gear pinion, said gear pinion being drivingly rotatable by said locking mechanism.

7. The locking arrangement of claim 6, further comprising arresting means for avoiding the separation of said lock body from at least one of said anchor members when said lock body is not secured to said anchor members by said dead-bolt member.

8. The locking arrangement of claim 7, wherein said arresting means comprises an extension of one of said projecting members, a slot formed along said one projecting member, a pin projected into said slot and adapted to enable a sliding movement, wherein said lock-body remains coupled to said extension when said lock body is not secured to said anchor members with said dead-bolt member.

9. The locking arrangement of claim 7, wherein one of said anchor members is fixed to a sliding door and the other to a respective sliding door jamb.

* * * * *